US005975794A

United States Patent [19]

Hedgewick

[11] Patent Number: 5,975,794

[45] Date of Patent: Nov. 2, 1999

[54] SNOWPLOWABLE PAVEMENT MARKER

[75] Inventor: Peter H. Hedgewick, Windsor, Canada

[73] Assignee: Pac-Tec, Inc., Heath, Ohio

[21] Appl. No.: 08/818,924

[22] Filed: Mar. 17, 1997

Related U.S. Application Data

[60] Provisional application No. 60/028,301, Oct. 11, 1996.

[51] Int. Cl.[6] ..... E01F 9/06

[52] U.S. Cl. ..... 404/14; 116/63 R; 404/16

[58] Field of Search ..... 404/12–16; 116/63 R

[56] References Cited

U.S. PATENT DOCUMENTS

| | | | |
|---|---|---|---|
| 3,587,416 | 6/1971 | Flanagan . | |
| 3,693,511 | 9/1972 | Medynski . | |
| 3,901,614 | 8/1975 | Overacker . | |
| 3,938,903 | 2/1976 | Montgomery . | |
| 3,971,623 | 7/1976 | Hedgewick et al. . | |
| 3,975,108 | 8/1976 | Suhr et al. . | |
| 4,008,973 | 2/1977 | Montigny . | |
| 4,155,666 | 5/1979 | Flanagan . | |
| 4,195,945 | 4/1980 | Heenan . | |
| 4,232,979 | 11/1980 | Johnson, Jr. et al. . | |
| 4,402,628 | 9/1983 | Grenier et al. . | |
| 4,557,624 | 12/1985 | Walker . | |
| 4,577,992 | 3/1986 | Jefferies . | |
| 4,753,548 | 6/1988 | Forrer . | |
| 4,797,024 | 1/1989 | Forrer . | |
| 4,815,890 | 3/1989 | Duncan . | |
| 4,875,798 | 10/1989 | May . | |
| 5,098,217 | 3/1992 | Hedgewick et al. . | |
| 5,104,256 | 4/1992 | D'Avela . | |
| 5,226,745 | 7/1993 | Gartlacher . | |
| 5,257,875 | 11/1993 | Flanagan | 404/14 |
| 5,454,664 | 10/1995 | Siblik | 404/14 |
| 5,564,854 | 10/1996 | Hedgewick . | |
| 5,681,128 | 10/1997 | Morgan et al. | 404/12 |

*Primary Examiner*—James A. Lisehora

*Attorney, Agent, or Firm*—Gifford, Krass, Groh, Spinkle, Anderson & Citkowski, P.C.

[57] ABSTRACT

A snowplowable retro-reflective pavement marker having a reflector mounted between a pair of flanged side ramps and a pair of center ramps. The side ramps have longitudinal flanges extending outwardly from each of the ramps to position the base properly with respect to the road surface. The flanges are tapered to provide a smooth contour for guiding snowplow blades when approaching from the side. The center ramps extend longitudinally on either side of the reflector to guide a snowplow blade when it engages the marker at a steep angle.

5 Claims, 2 Drawing Sheets

SNOWPLOWABLE PAVEMENT MARKER

This application claims the benefit of U.S. Provisional Application No. 60/028,301, filed Oct. 11, 1996.

BACKGROUND OF THE INVENTION

I. Field of the Invention

The invention relates to a retro-reflective marker for mounting to roads, and more particularly, to a snowplowable marker having ramps to protect a reflector.

II. Description of the Prior Art

In many regions, plastic retro-reflective road markers are mounted to the road surface to delineate the lanes. Retro-reflective markers mounted directly into the road surface are frequently removed or damaged by the passing of snowplow blades in regions where snowplows are used to clear the roads. In these regions, it has become a practice to mount the plastic marker with a retro-reflective lens in a metal casting base member such as disclosed in U.S. Pat. No. 4,147,447. The base member includes a pair of spaced apart keel portions which are mounted in grooves formed in the pavement. The upper portion of the keels define a pair of ramps for deflecting the snowplow blades from a plastic reflector. The reflector is mounted between the longitudinal ramps in a center portion of the casting extending between the keels. However, the reflector lenses of previously known markers have been damaged when the blade of a snowplow is angled sharply. When the blade is sharply angled, such as 45° to the axis of the road, the corner of the blade can pass between the ramps to damage the marker before it is deflected by the ramps.

Additionally, it has been difficult to accurately position prior art castings with respect to the road surface. If the casting is placed too low, the lens is obscured and there is insufficient light reflected from the lens to delineate the lane. If the casting extends too far above the road surface it becomes a hazard for vehicles passing over it and is more likely to be dislodged by the blades of the snowplow.

Accordingly, it is desirable to have a casting for a snowplowable road marker which properly provides full protection for the marker from damage by the snowplow blade and can be accurately positioned with respect to the road surface.

SUMMARY OF THE INVENTION

The invention includes a metal base and a plastic reflector. The base has low profile flanged side ramps and a pair of center ramps. The reflector is mounted between the pair of side ramps and the pair of center ramps. A tapered flange extends outwardly from each side ramp over the road surface. An upper surface of the flange and ramp provides a smooth continuous surface for lifting the snowplow blade up and over the reflector. Each flange has a lower surface formed to rest on the road surface to accurately position the base and reflector with respect to the road surface. The flanges have a radiused periphery to prevent any sharp edges from engagement with the edge of the snowplow. The center ramps are disposed on either side of the reflector along the longitudinal axis of the base and angle upwardly at approximately the same angle as the side ramps to guide the blade of the snowplow over the reflector. This arrangement results in a marker which may be easily traversed by a tire because it has wide ramps which are shorter in length than previous castings and provides lifting surfaces for lifting the blade of the snowplow regardless of the angle of incidence with the base.

BRIEF DESCRIPTION OF THE DRAWING

The present invention will be more fully understood by reference to the following detailed description, when read in conjunction with the accompanying drawings, in which like reference characters refer to like parts throughout the several views and in which.

DESCRIPTION OF THE PREFERRED EMBODIMENTS

Description of the Invention

Figure 1:
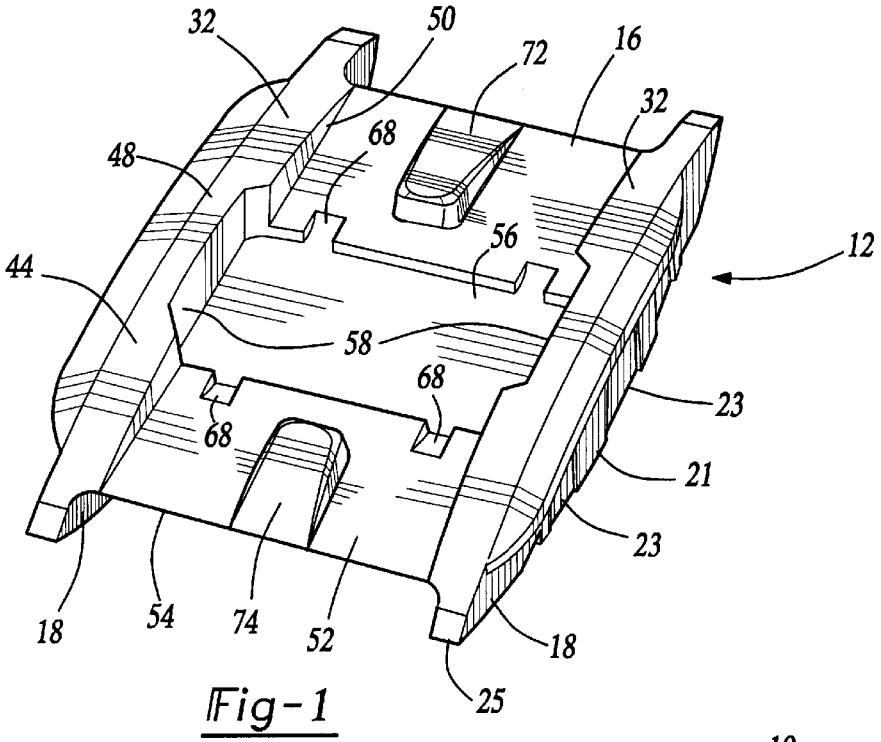
FIG. 1 is a perspective view of a base in accordance with the invention.
Figure 2:
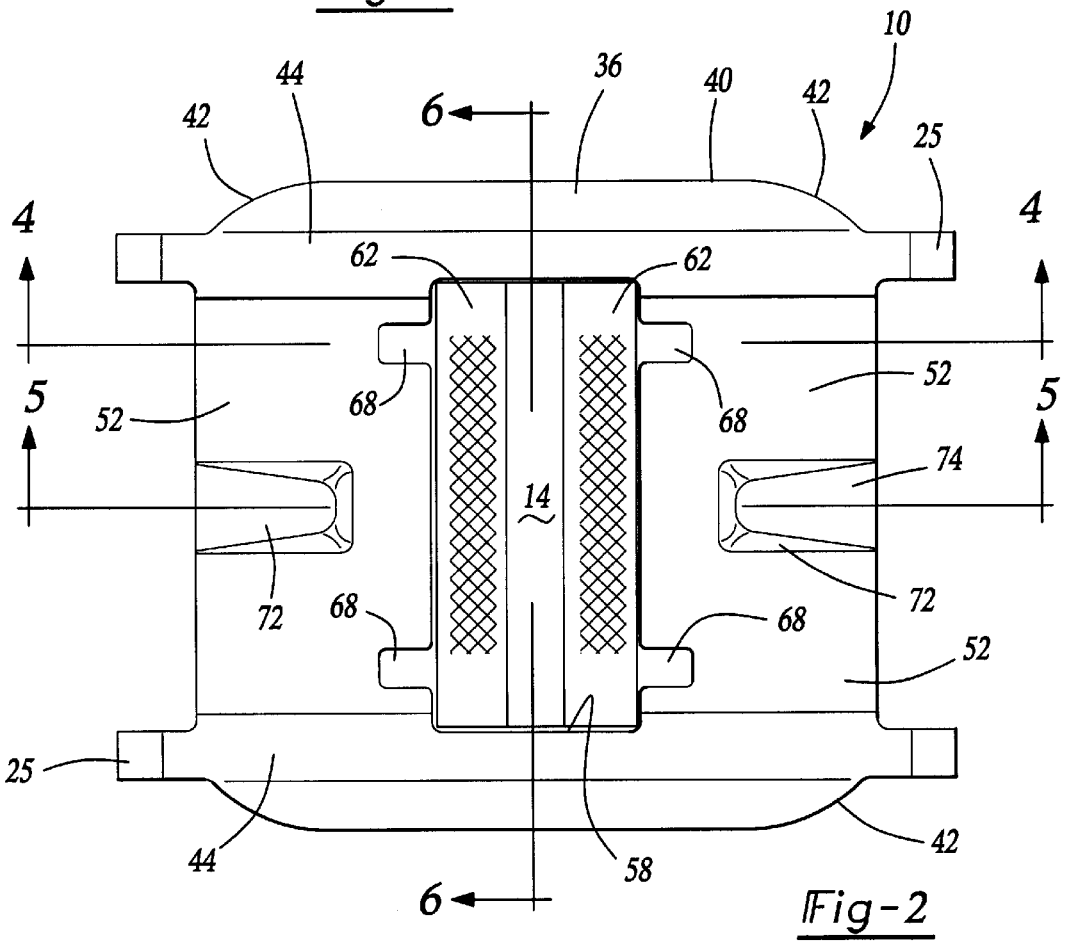
FIG. 2 is a top view of a base with a reflector in position in accordance with the invention.
Figure 3:
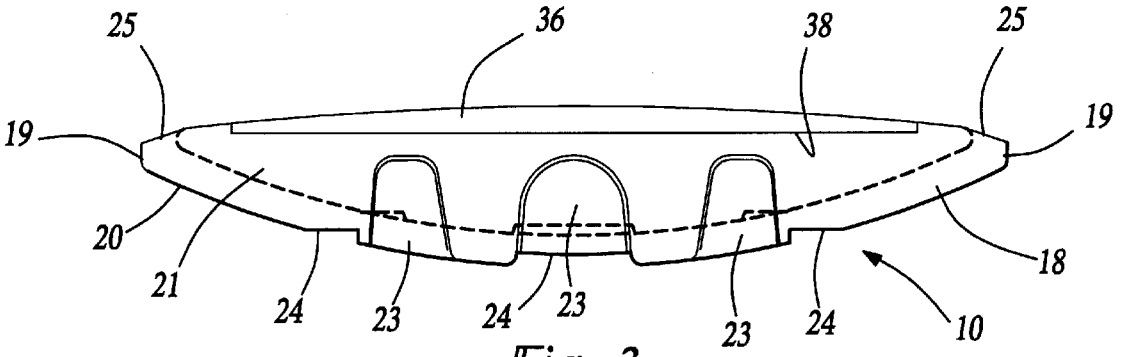
FIG. 3 is a side view of the base in accordance with the invention.

In accordance with the invention, a low profile snowplowable road marker 10 for installation in road pavement 26 in accordance with the invention is shown in FIGS. 1 and 2. The road marker 10 includes a metal base 12 and retro-reflector 14 which is mounted to the base 12. The base 12 is cast metal having a lower portion which is mounted in the pavement and an upper portion for protecting the reflector from a blade of a snowplow. The lower portion includes a center portion 16 positioned between two longitudinal rails 18. Each rail 18 has a side wall 21 extending to a pair of ends 19 and an arcuate lower edge 20. The side wall 21 has indentations 23 and the lower edge 20 has notches 24 for engaging adhesive to mount the base 12 in the pavement. Each rail has a short sloped top surface 25 extends upwardly and inwardly from each end 19 to a ramp 32.

Figure 4:
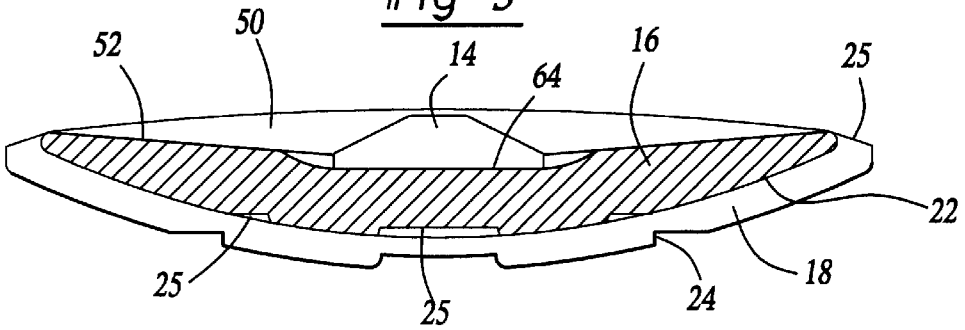
FIG. 4 is a cross-sectional view of the base taken along lines 4—4 of FIG. 2.
Figure 6:
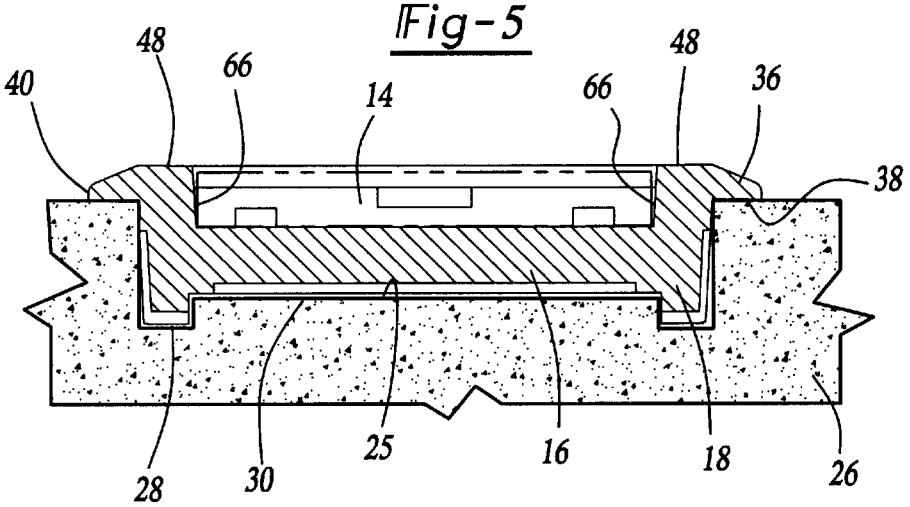
FIG. 6 is a transverse cross-sectional view of the base and reflector taken along lines 6—6 of FIG. 2.

As shown in FIGS. 4 and 6, the center portion 16 likewise has an arcuate surface 22 with notches 25 similar to the notches 24 of the rail. The lower surface 22 of the center portion 16 does not extend as deeply as the lower edges 20 of the side rails 18. As shown in FIG. 6, the base 12 is mounted in an arcuate groove carved in the road 26 in the same manner as disclosed in U.S. Pat. No. 4,174,184 and shown in FIG. 6. The groove has two outer slots 28 which extend into the road 26 more deeply than a center portion 30 to accommodate the rails 18 and center body 16, respectively.

As shown in FIGS. 1, 2, and 6, a low profile side ramp 32 extends upwardly from each rail 18. Each ramp 32 includes an elongated tapered flange 36 which extends outwardly approximately ½" from the side wall 21 of each of the rails 18. The flange extends most of the longitudinal length of the ramp or approximately 80% of the length of the ramp. The flange 36 has a flat lower surface 38 formed to rest on the top surface of the pavement 26. The flange 36 has an outer peripheral edge 40 which is generally parallel with the associated rail 18 and has ends 42 which curve inwardly toward the rail 18. The flange 36 has a top surface which angles upwardly from the peripheral edge 40 toward a smooth contoured ramp surface 44. The ramp surface 44 extends from the top surface 25 of each rail 18 upwardly to a center portion 48 which is located approximately ¼" above the road surface. The ramp surface 44 extends inwardly to a side wall 50 and is somewhat wider than the associated rail 18. The side wall 50 extends downwardly to the center portion 16. Because the ends 19 of the rails 18 are mounted below the road surface, the snowplow blade will first contact the angled top portion 25 of the rail or the ramp 32 or the tapered peripheral edge 40 of the flange to be lifted smoothly up and over the ramp 32.

As shown in FIGS. 1, 2, and 4, the center portion 16 of the casting has a pair of inclined upper surfaces 52 which extend downwardly and inwardly between the side walls 50 to a rectangular recess 56 for mounting the reflector 14. Each upper surface has a length which is generally equal to half the width of the reflector 14. Each upper surface 52 has an outer edge 54 extending on a vertical plane which continues to the ends 42 of the flange 36. The recess 56 has a bottom surface 70 extending across the center of the center portion 16 of the base 12 between notches 58 formed in the side walls to accomodate the reflector 14.

As shown in FIGS. 2 and 6, the reflector 14 is of a conventional type having cube-corner retro-reflective lens portions 62 on opposite sides of the reflector. Alternatively, the marker can have only one reflective lens or two lenses of different colors. The marker has a top 60, a bottom 64 and a pair of ends 66. The pair of ends 66 and the bottom 64 are located in the notches 58 and recess 56, respectively, of the base 12. The top is mounted below the level of the center portion 48 of the rails 18. As known in the art, a suitable adhesive is used to secure the reflector 14 to the base 12.

Figure 5:
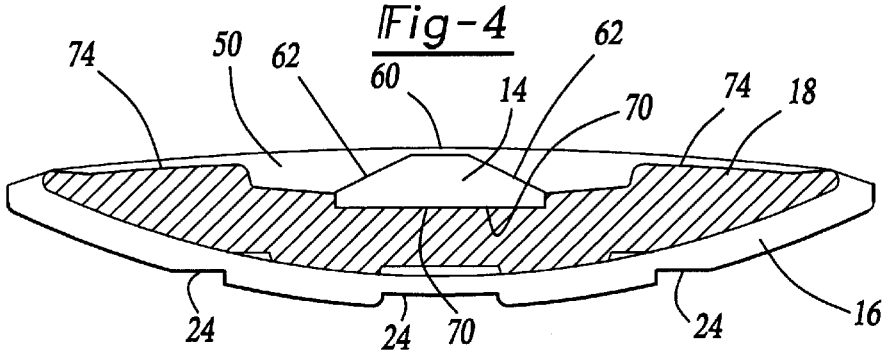
FIG. 5 is a cross-sectional view of the base and reflector taken along lines 5—5 of FIG. 2.

As shown in FIGS. 1, 2, and 5, a center ramp 72 extends upwardly from each upper surface 56 along a longitudinal axis of the base. The center ramp 72 has a top surface 74 which slopes upwardly from the outer edge 54 of the upper surface 56 in a generally parallel alignment with the ramp surfaces 44. The center ramp 72 terminates a distance, such as ½", before the recess for the retro-reflector.

As shown in FIGS. 1, 2, and 4, a pair of slots 68 are formed at the lower end of each top surface 52 to extend to the bottom surface 70 of the recess 56 to permit insertion of a tool such as a screwdriver blade (not shown) under the retro-reflector for replacement of a damaged reflector 14.

Accordingly, disclosed is a three ramp snowplowable road marker having flanged side ramps and center ramps to guide the blade of the plow from contact with the reflector. The blade is lifted and guided smoothly by the side and center ramps to avoid bounces which would cause breakage to or dislodgement. The center ramp 72 advantageously acts to guide the end of the plow over the reflector when the blade is positioned in an extreme angle. The snowplowable marker has a shorter longitudinal length than conventional two rail markers and has a low profile which is easily traversed by the tires of a vehicle. The flanged side ramps also permit precise positioning of the base with respect to the road surface.

Having described my invention, however, many modifications thereto may become apparent to those skilled in the art. These and other changes are within the spirit of the invention as defined by the scope of the appended claims.

I claim:

1. A base for a snowplowable road marker having a reflector, said reflector having a predetermined width extending between a pair of ends, said base mounted in a road surface, said base comprising:

an elongated body having a longitudinal axis and a lower portion adapted for mounting in the road surface;

a pair of spaced apart side ramps extending above the lower portion and parallel to said longitudinal axis;

a center portion extending between the ramps, said center portion having a pair of upper surfaces extending transversely between said ramps and inclined downwardly toward a mounting surface, each of said upper surfaces having a predetermined length extending alone said longitudinal axis which is generally equal to half of the predetermined width of the reflector, each of said upper surfaces having a center ramp aligned on said longitudinal axis; and means for mounting said reflector to said center portion of said body between said spaced apart side ramps and said pair of center ramps.

2. The base as claimed in claim 1, further comprising said center portion having a pair of edges extending between said side ramps and each of said pair of center ramps extending from one of said pair of edges.

3. The base as claimed in claim 2, wherein each of said center ramps further comprises a top plane extending on a surface extending across a top surface of said side ramps.

4. The base as claimed in claim 1, wherein each of said side ramps has a longitudinal flange extending outwardly from said base.

5. The base as claimed in claim 4, wherein each flange has a top surface extending on an angle from said pavement to said ramp surface.

* * * * *